US008281432B2

(12) United States Patent
Finell

(10) Patent No.: US 8,281,432 B2
(45) Date of Patent: Oct. 9, 2012

(54) CRIB BUMPER AND BED STRUCTURE FORMED THEREWITH

(75) Inventor: Rebecca M. Finell, Tempe, AZ (US)

(73) Assignee: BKD Acquisition, Inc., Oak Brook, IL (US)

( * ) Notice: Subject to any disclaimer, the term of this patent is extended or adjusted under 35 U.S.C. 154(b) by 0 days.

(21) Appl. No.: 12/605,713

(22) Filed: Oct. 26, 2009

(65) Prior Publication Data

US 2010/0037393 A1 Feb. 18, 2010

Related U.S. Application Data

(63) Continuation of application No. 11/486,905, filed on Jul. 14, 2006, now abandoned.

(60) Provisional application No. 60/700,470, filed on Jul. 19, 2005.

(51) Int. Cl.
*A47C 27/08* (2006.01)

(52) U.S. Cl. ..... 5/424; 5/93.1; 5/425; 5/663; 5/946

(58) Field of Classification Search ..... 5/100, 93.1
See application file for complete search history.

(56) References Cited

U.S. PATENT DOCUMENTS

| | | | | | |
|---|---|---|---|---|---|
| 421,656 | A * | 2/1890 | Blanken | 5/425 |
| 3,877,090 | A * | 4/1975 | Schutz | 5/93.1 |
| 4,800,600 | A * | 1/1989 | Baum | 5/93.1 |
| 5,118,318 | A * | 6/1992 | Lorizio | 446/72 |
| 5,410,765 | A * | 5/1995 | Youngblood | 5/93.1 |
| 5,437,071 | A * | 8/1995 | Feigenbaum | 5/663 |
| 5,706,534 | A * | 1/1998 | Sherman | 5/424 |
| 5,933,885 | A * | 8/1999 | Glassford | 5/424 |
| 5,937,458 | A * | 8/1999 | DeRosa | 5/424 |
| 6,105,186 | A * | 8/2000 | Stone Munson | 5/482 |
| 6,131,216 | A * | 10/2000 | Pine | 5/93.1 |
| 6,170,101 | B1 * | 1/2001 | McCloud | 5/424 |
| 6,178,573 | B1 * | 1/2001 | Wagner et al. | 5/424 |
| 6,434,767 | B1 * | 8/2002 | Welsh, Jr. | 5/93.2 |
| 6,438,775 | B1 * | 8/2002 | Koenig | 5/424 |
| 6,564,403 | B1 * | 5/2003 | Titus | 5/425 |
| 6,684,437 | B2 * | 2/2004 | Koenig | 5/726 |
| 6,711,768 | B2 * | 3/2004 | Maldonado | 5/636 |
| 6,772,457 | B1 * | 8/2004 | Alaback | 5/93.1 |
| 6,799,337 | B1 * | 10/2004 | Raphael-Davis et al. | 5/93.1 |
| 6,823,543 | B2 * | 11/2004 | Diak/Ghanem | 5/496 |
| 6,957,455 | B1 * | 10/2005 | Misson | 5/425 |
| 6,957,464 | B1 * | 10/2005 | Coauette | 5/663 |
| 7,716,760 | B1 * | 5/2010 | Alaback | 5/93.1 |
| 2001/0000362 | A1 * | 4/2001 | Wagner et al. | 5/424 |
| 2002/0092094 | A1 * | 7/2002 | Welsh, Jr. | 5/95 |
| 2004/0261174 | A1 * | 12/2004 | DeHart et al. | 5/93.1 |

* cited by examiner

*Primary Examiner* — Carlos Lugo
*Assistant Examiner* — Alyson M Merlino
(74) *Attorney, Agent, or Firm* — Michael Best & Friedrich LLP

(57) ABSTRACT

A crib bumper (23) includes a mattress-receiving base (40), and a continuous sidewall or row of bumper elements (50) attached to, and extending upright relative to, the base (40) encircling and defining a mattress-receiving opening (51) into a mattress-receiving area (51A) formed by base (40). A supporting spine (71) is coupled between the base (40) and each of the bumper elements (50) maintaining the bumper elements (50) upright relative to the base (40).

13 Claims, 14 Drawing Sheets

CRIB BUMPER AND BED STRUCTURE FORMED THEREWITH

CROSS REFERENCE TO RELATED APPLICATION

This application claims the benefit of U.S. Provisional Application No. 60/700,470, filed Jul. 19, 2005.

FIELD OF THE INVENTION

The present invention relates to bedsteads and to bedstead bedding.

BACKGROUND OF THE INVENTION

One of the most important investments new parents make anticipating the birth of their first child is the purchase of a crib. Because a baby can be expected to use a crib for the first two to three years of life, and because a good crib can be handed down from generation to generation, the importance of choosing a suitable crib cannot be overemphasized. It is important to order a crib well in advance of the birth of a child, since stores typically do not keep many cribs in stock and shipping can take days or weeks. Once receiving a crib, it usually must be assembled, and furnished with a mattress and bedding.

Of equal importance to the choice of a suitable crib is the selection of bedding, including a crib bumper. A typical crib bumper incorporates lightly padded cloth panels that line the inside of the crib to prevent a baby from hurting herself on the slats of the crib, and that help keep arms and legs inside the crib where they belong.

Crib bumpers are provided in many different forms and styles. Although there are many varieties of crib bumpers currently available, existing crib bumpers are not entirely acceptable. For instance, some crib bumpers are not easily installed, whereas others, while easy to install, are too easily dislodged preventing them from functioning properly, and incorporate ties or other ineffectual fasteners that secure them to the crib and which are, however, easily torn and broken. Other deficiencies are also noted, thereby necessitating continued improvement in the art of crib bumpers.

SUMMARY OF THE INVENTION

According to the principle of the invention, a bed structure includes a mattress carried by a bedstead including enclosing sides encircling the mattress and extending upwardly therefrom defining an enclosed space overlying the mattress, bumper elements encircling and extending upright relative to the mattress juxtaposed relative to the enclosing sides of bedstead cooperating together providing a protective barrier between the enclosing sides of the bedstead and the enclosed space overlying the mattress, and a supporting spine coupled to each of the bumper elements maintaining the bumper elements upright relative to the mattress juxtaposed relative to the enclosing sides of the bedstead. A base is positioned between the bedstead and the mattress, the bumper elements are carried by the base, and the supporting spines are coupled between the base and the bumper elements, respectively, maintaining the bumper elements upright relative to the base. The supporting spines are enclosed within the base and the bumper elements, respectively. A decorative attachment has a lower end coupled to the base and an opposing decorative upper end, the decorative upper end extending upwardly relative to the mattress juxtaposed relative to the protective barrier formed by the bumper elements. The decorative upper end further extends upwardly relative to the protective barrier formed by the bumper elements. An engagement assembly couples the lower end of the decorative attachment to the base including an element thereof carried by the base engaged to a complemental element thereof carried by the lower end of the decorative element. The base consists of a broad sheet defining an outer perimeter edge, and a continuous sidewall having a continuous lower edge attached to perimeter edge and projecting upwardly therefrom terminating with a continuous upper edge. A mattress-receiving area is bound by and between the broad sheet and the continuous sidewall, the mattress is received in the mattress-receiving area in which the continuous sidewall encircles the perimeter of the mattress between the perimeter of the mattress and the enclosing sides of the bedstead, the bumper elements are attached to, and project upwardly from, the continuous upper edge of the continuous sidewall, and the supporting spines extend between, and are enclosed within, the continuous sidewall and the bumper elements, respectively.

According to the principle of the invention, a bed structure consists of a mattress carried by a bedstead including enclosing sides encircling the mattress and extending upwardly therefrom defining an enclosed space overlying the mattress. A base is positioned between the bedstead and the mattress. Bumper elements are carried by the base, which encircle and extend upright relative to the mattress juxtaposed relative to the enclosing sides of bedstead cooperating together providing a protective barrier between the enclosing sides of the bedstead and the enclosed space overlying the mattress. A supporting spine is coupled between the base and each of the bumper elements maintaining the bumper elements upright relative to the mattress juxtaposed relative to the enclosing sides of the bedstead. The supporting spines are enclosed within the base and the bumper elements, respectively. A decorative attachment has a lower end coupled to the base and an opposing decorative upper end, which extends upwardly relative to the mattress juxtaposed relative to the protective barrier formed by the bumper elements. The decorative upper end of the decorative attachment further extends upwardly relative to the protective barrier formed by the bumper elements. An engagement assembly couples the lower end of the decorative attachment to the base, which includes an element thereof carried by the base engaged to a complemental element thereof carried by the lower end of the decorative element.

According to the principle of the invention, a bed structure includes a mattress, having a perimeter and a sleeping surface, carried by a bedstead including enclosing sides encircling the perimeter of the mattress and extending upwardly therefrom the sleeping surface defining an enclosed space overlying the sleeping surface. A base is positioned between the bedstead and the mattress. The base has a continuous sidewall encircling the perimeter of the mattress. Bumper elements are attached to the continuous sidewall, and extend upright therefrom relative to the mattress juxtaposed relative to the enclosing sides of bedstead cooperating together providing a protective barrier between the enclosing sides of the bedstead and the enclosed space overlying the mattress. A supporting spine is coupled between the continuous sidewall and each of the bumper elements maintaining the bumper elements upright relative to the mattress juxtaposed relative to the enclosing sides of the bedstead. The supporting spines are enclosed within the continuous sidewall and the bumper elements, respectively. A decorative attachment has a lower end coupled to the continuous sidewall and an opposing decorative upper end, which extends upwardly relative to the mattress juxtaposed relative to the protective barrier formed by the bumper elements. The decorative upper end further extends upwardly relative to the protective barrier formed by the bumper elements. An engagement assembly couples the lower end of the decorative attachment to the continuous sidewall, which includes an element thereof carried by the continuous sidewall engaged to a complemental element thereof carried by the lower end of the decorative element. Elastic structure associated with the continuous sidewall of the base elastically constricts the continuous sidewall relative to the perimeter of the mattress elastically retaining the base to the mattress.

According to the principle of the invention, a crib bumper includes a mattress-receiving base, and continuous sidewall of bumper elements attached to, and extending upright relative to, the base encircling and defining a mattress-receiving opening into the base. A supporting spine is coupled between the base and each of the bumper elements maintaining the bumper elements upright relative to the base. The supporting spines are enclosed within the base and the bumper elements, respectively. Elastic structure associated with the continuous sidewall of the base is provided for elastically constricting the continuous sidewall to a mattress received by the base. According to a preferred embodiment, the base consists of a broad sheet defining an outer perimeter edge, and a continuous sidewall having a continuous lower edge attached to perimeter edge and projecting upwardly therefrom terminating with a continuous upper edge. The bumper elements are attached to, and project upwardly from, the continuous upper edge of the continuous sidewall, and the supporting spines extend between, and are enclosed within, the continuous sidewall and the bumper elements, respectively. A mattress-receiving area is bound by and between the broad sheet and the continuous sidewall.

BRIEF DESCRIPTION OF THE DRAWINGS

Referring to the drawings.

DETAILED DESCRIPTION OF PREFERRED EMBODIMENTS

Figure 1:
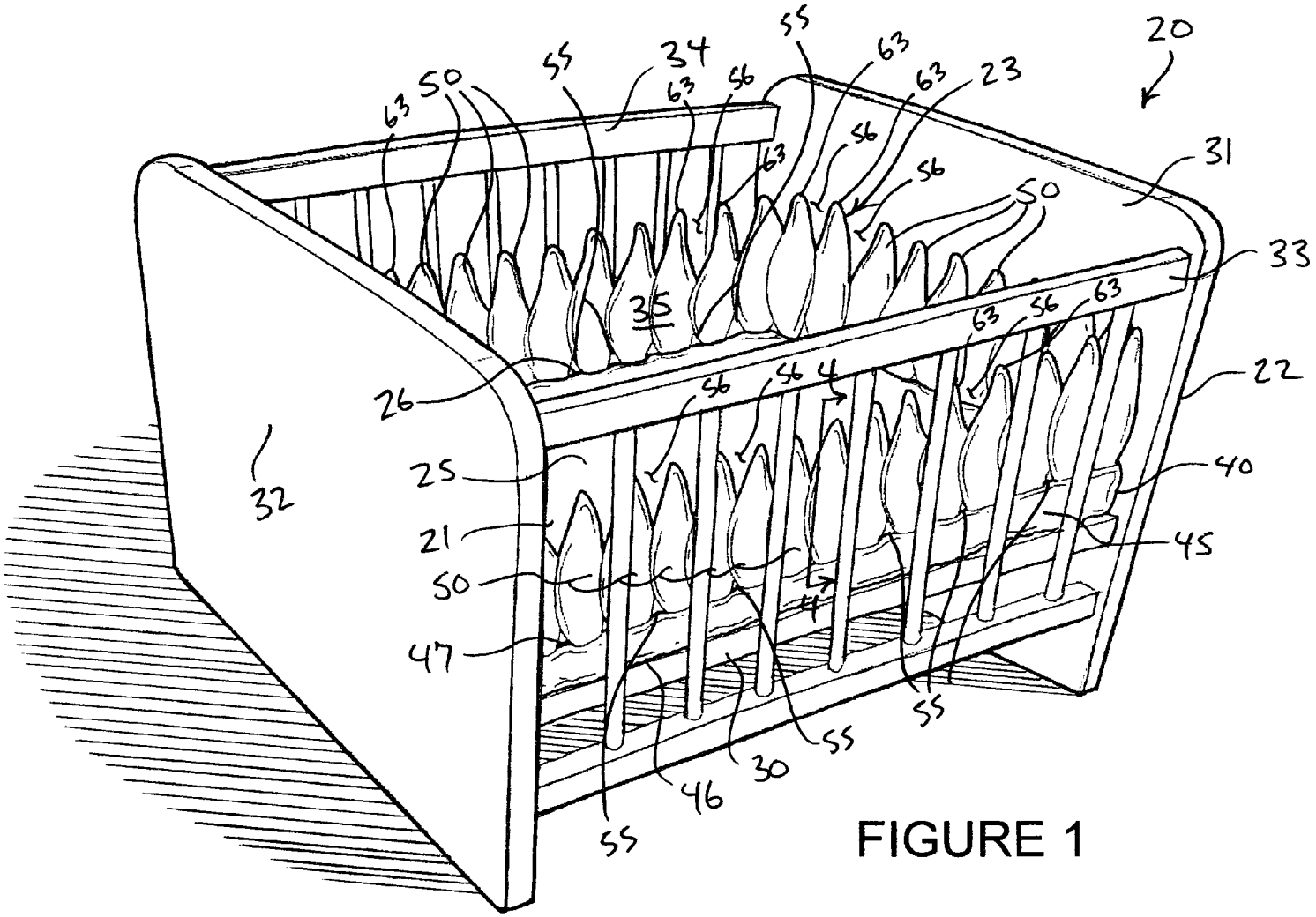
FIG. 1 is a perspective view of a bed structure incorporating a crib bumper constructed and arranged in accordance with the principle of the invention.

Turning now to the drawings, in which like reference characters indicate corresponding elements throughout the several views, attention is first directed to FIG. 1 in which there is seen a bed structure 20 consisting of a mattress 21 carried by a bedstead 22. Bed structure 20 incorporates a crib bumper 23, constructed and arranged in accordance with the principle of the invention, lining the inside of bedstead 22 for preventing a baby from hurting himself on bedstead 22, and helping keep arms and legs inside bedstead 22 where they belong.

Figure 2:
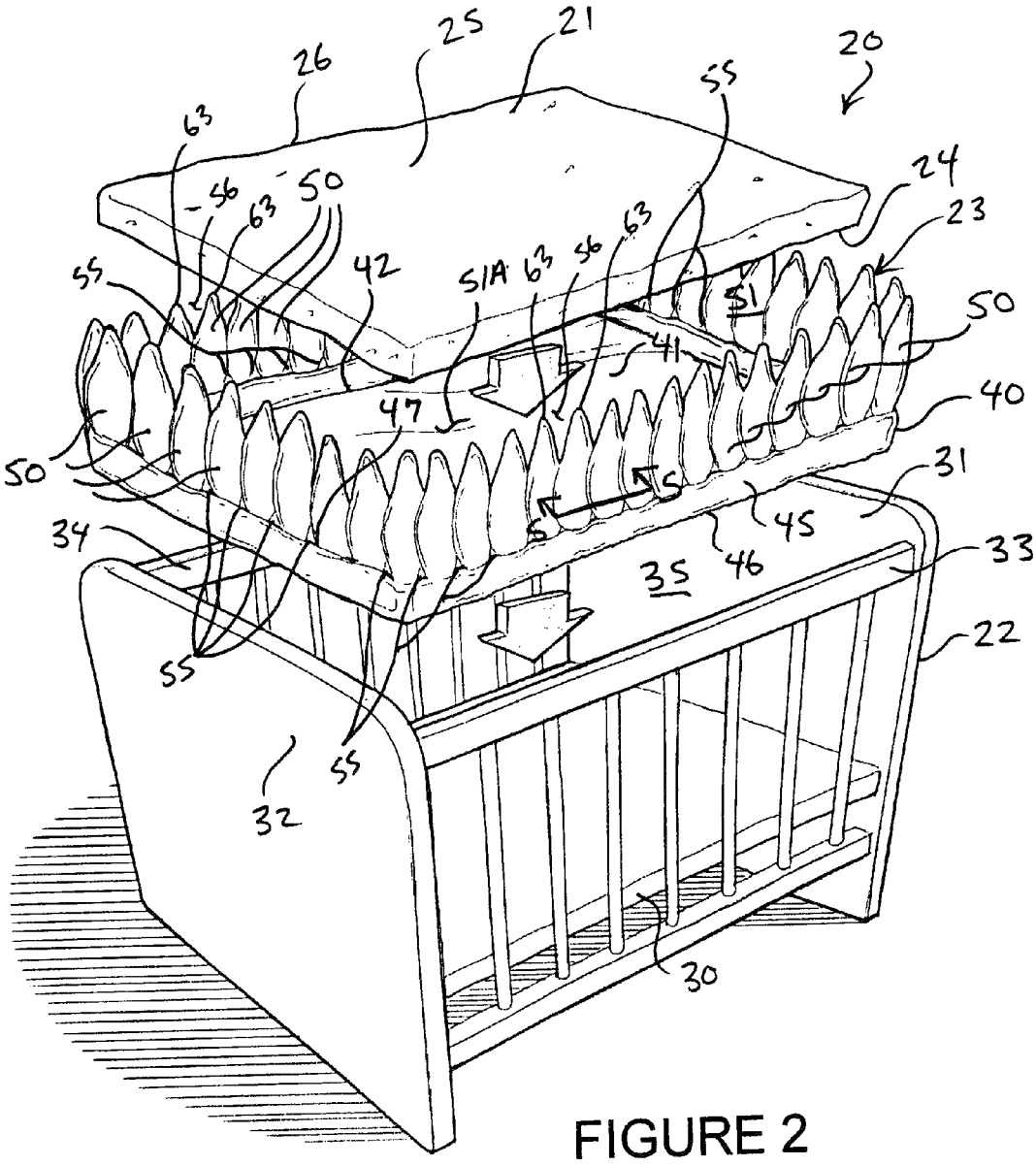
FIG. 2 is an exploded perspective view of the bed structure of FIG. 1 illustrating a bedstead, the crib bumper, and a mattress.

Referring to FIG. 2, mattress 21 is a pliant, soft encasement filled with resilient material such as cotton, hair, feathers, foam rubber, or an arrangement of coiled springs, and defines opposed parallel lower and upper 24 and 25 surfaces, and a perimeter 26. For the purposes of orientation and reference, upper surface 25 is considered a sleeping surface, and is referred to as such henceforth.

Bedstead 22 is fashioned of wood, engineered wood, metal, plastic, or the like, and consists of a mattress support 30 carried by upstanding, enclosing sides of bedstead 22, which consist of opposed, parallel, upstanding endwalls 31 and 32, and opposed, parallel, upstanding sidewalls 33 and 34 coupled to, and extending therebetween, endwalls 31 and 32, and which together encircle mattress support 23 and extend upwardly therefrom forming an enclosing structure defining an enclosed space 35 overlying mattress support 23. Mattress 21 is situated on, and supported by, mattress support 23 as seen in FIG. 1, whereby endwalls 31 and 32, and sidewalls 33 and 34 encircle mattress 21 and extend upwardly therefrom defining enclosed space 35 overlying sleeping surface 24. Endwalls 31 and 32 constitute the footboard and endboard, respectively, of bedstead 22, and sidewalls 33 and 34 constitute the lateral sides of bedstead 22. In this instance, mattress support 30 is a platform. In another embodiment, mattress support 30 can be a box spring set onto a box spring support incorporated with bedstead 22. Any suitable mattress support can be used consistent with the teachings of the invention.

Bedstead 22 is essentially a rectangular box that supports mattress support 30, and is generally representative of a conventional baby crib. Mattress 21 is, in turn, generally representative of a conventional crib mattress. As a matter of illustration, sidewalls 33 and 34 are slatted, and endwalls 31 and 32 are not, although they may be slatted like sidewalls 33 and 34, if desired. Endwalls 31 and 32 may also be slatted, if desired. One or each of sidewalls 33 and 34 may be a drop side, if desired, namely, a side that may be lowered, as with a lift-and-press action, a foot release, or a two-hand-operated latch mechanism, which makes it easier to reach in and tend to a baby. There are many different brands of crib bedsteads that may be used for bedstead 22, including Alta Baby, Angel Line, Babi Italia, Baby's Dream, Bellini, Child Craft, Childesigns, Delta, Dorel Juvenile Group (Costco), Evenflo, Fisher-Price (Storkcraft), Jardine, Kindercraft, and Simmons, to name a few. Given that bedstead 22 and mattress 21 are entirely conventional being generally representative of a typical crib-and-mattress bed structure, further details of bedstead 22 and mattress 21 will readily occur to those having regard for the art and will not be discussed in further detail.

Referring to FIG. 2, crib bumper 23 consists of a base 40 including a broad sheet 41 defining an outer perimeter edge 42, that in turn defines a shape of sheet 41, which in this instance is generally rectangular. A corresponding, generally rectangular continuous sidewall 45 has a continuous lower edge 46 attached to perimeter edge 42, and projects upwardly therefrom terminating with a continuous upper edge 47. Base 40 is pliant and soft and flexible, and is fashioned preferably of cloth fabric, whereby the described components of base 40 are sewn and/or glued together.

Bumper elements 50 are attached to upper continuous edge 47 of continuous sidewall 45, and extend upright relative thereto cooperating together forming a continuous row or sidewall of bumper elements 50. Referencing FIGS. 1 and 2, a plurality of lower gaps 55 are formed in crib bumper 23, and a plurality of upper gaps 56 are formed in crib bumper opposing lower gaps 55. As clearly shown in FIGS. 1 and 2, each lower gap 55 is formed at and between each pair of opposed bumper elements 50 adjacent to upper continuous edge 47 of continuous sidewall 45 of base 40. Bumper elements 50 are substantially equal in size and shape, and cooperate defining a mattress-receiving opening 51 into a mattress receiving area 51A defined by and between, or otherwise bound by and between, sheet 41 and continuous sidewall 45 of base 40 as referenced in FIG. 2. Bumper elements 50 can be differently sized and/or shaped, if desired. Bumper elements 50 are common in structure, in which the structural details of only one bumper element 50 will be described in detail with the understanding that the ensuing discussion of one bumper element 50, and the reference characters associated therewith, apply to each of the bumper element 50.

Figure 4:
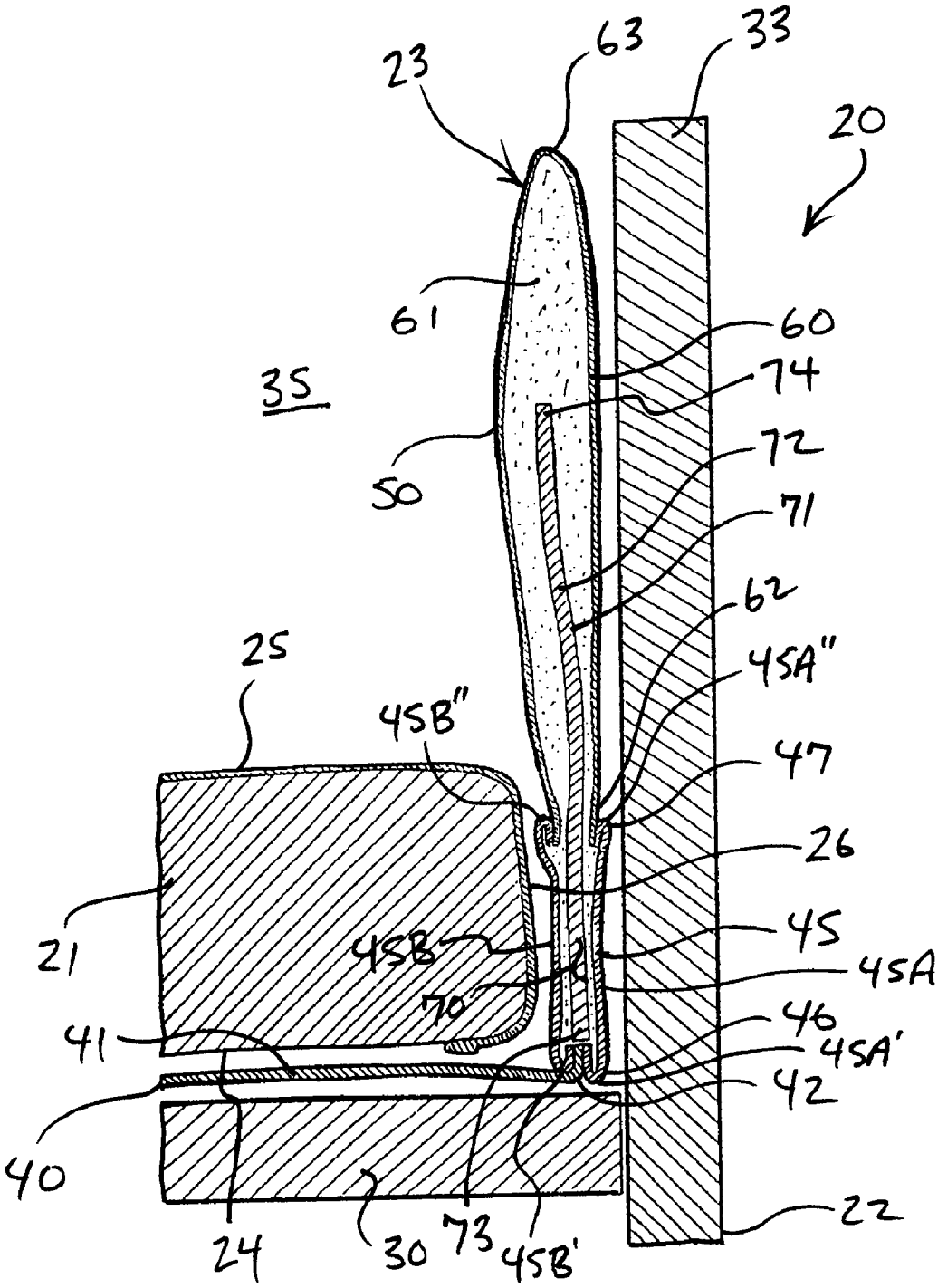
FIG. 4 is a sectional view taken along line 4-4 of FIG. 1.

Referring to FIG. 4, bumper element 50 is an elongate, pliant, soft encasement consisting of an outer form or sheath 60 filled with an inner filling or form 61 of resilient material such as cotton, hair, feathers, foam rubber, or the like or a combination thereof. The encasement forming bumper element has a lower end 62 affixed to continuous upper edge 47, and extends upwardly therefrom to an opposing upper end 63. Outer form or sheath 60 is pliant and soft and flexible, and is fashioned preferably of cloth fabric. Lower end 62 of bumper element 50 is secured to continuous upper edge 47 with sewing or glue or the like.

In this preferred embodiment, continuous sidewall 45 is formed by opposed courses 45A and 45B of material, which are brought together and their respective lower edges 45A' and 45B' and secured, such as by sewing or gluing, to perimeter edge 42 of sheet 41 and their respective upper edges 45A" and 45B" secured, such as by sewing or gluing, to lower end 62 of bumper element 50. Lower edges 45A' and 45A' of courses 45A and 45B together form or constitute continuous lower edge 46 of continuous sidewall 45, and upper edges 45A" and 45B" of courses 45A and 45B together form or constitute continuous upper edge 47 of continuous sidewall 45. A pocket 70 is formed between courses 45A and 45B. Lower end 62 of bumper element 50 is open, as is continuous upper edge 47 of continuous sidewall 45 formed by upper edges 45A" and 45B".

A supporting spine 71 is coupled between base 40 and bumper element 50, which maintains bumper element 50 upright relative to base 40, in accordance with the principle of the invention. Supporting spine 71 is an elongate body or member 72 having a rigidity capable of maintaining bumper element 50 upright relative to base 40. In the present embodiment, elongate member 72 is relatively broad and flat resembling a tongue depressor, which has opposed lower and upper ends 73 and 74, respectively, and which is fashioned of plastic, metal, wood, engineered wood, or other substantially rigid material or combination of materials. Elongate member 72 can take on any desired shape. Elongate member 72 may also be configured as an air- or fluid-inflated bladder, if desired, or other structure having a rigidity sufficient to maintain bumper element 50 upright relative to base 40.

Supporting spine 71 is enclosed within base 40 and bumper element 50, whereby lower end 73 is located in pocket 70, and supporting spine 71 extends upwardly therefrom into and through open lower end 62 of bumper element 50 and into inner form 61 terminating with upper end 74, which is embedded in inner form 61 and directed toward upper end 63 of bumper element 50. Supporting spine 71 is encased or otherwise enclosed in continuous sidewall 45 of base 40 and in bumper element 50 preventing supporting spine 71 from scratching or injuring a baby.

Figure 3:
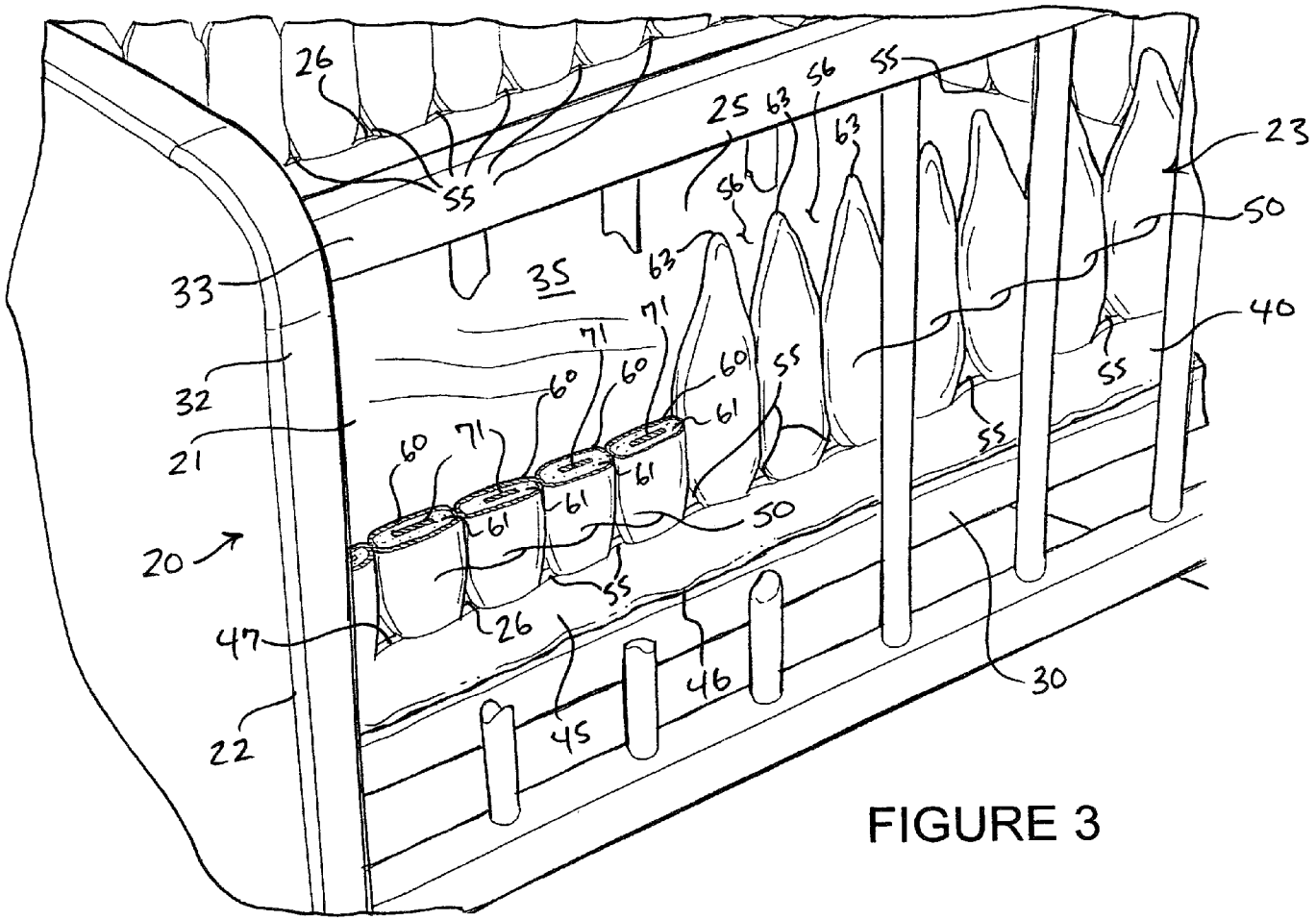
FIG. 3 is an enlarged fragmented perspective view of the bed structure of FIG. 1 with portions thereof and of the crib bumper broken away for illustrative purposes.
Figure 5:
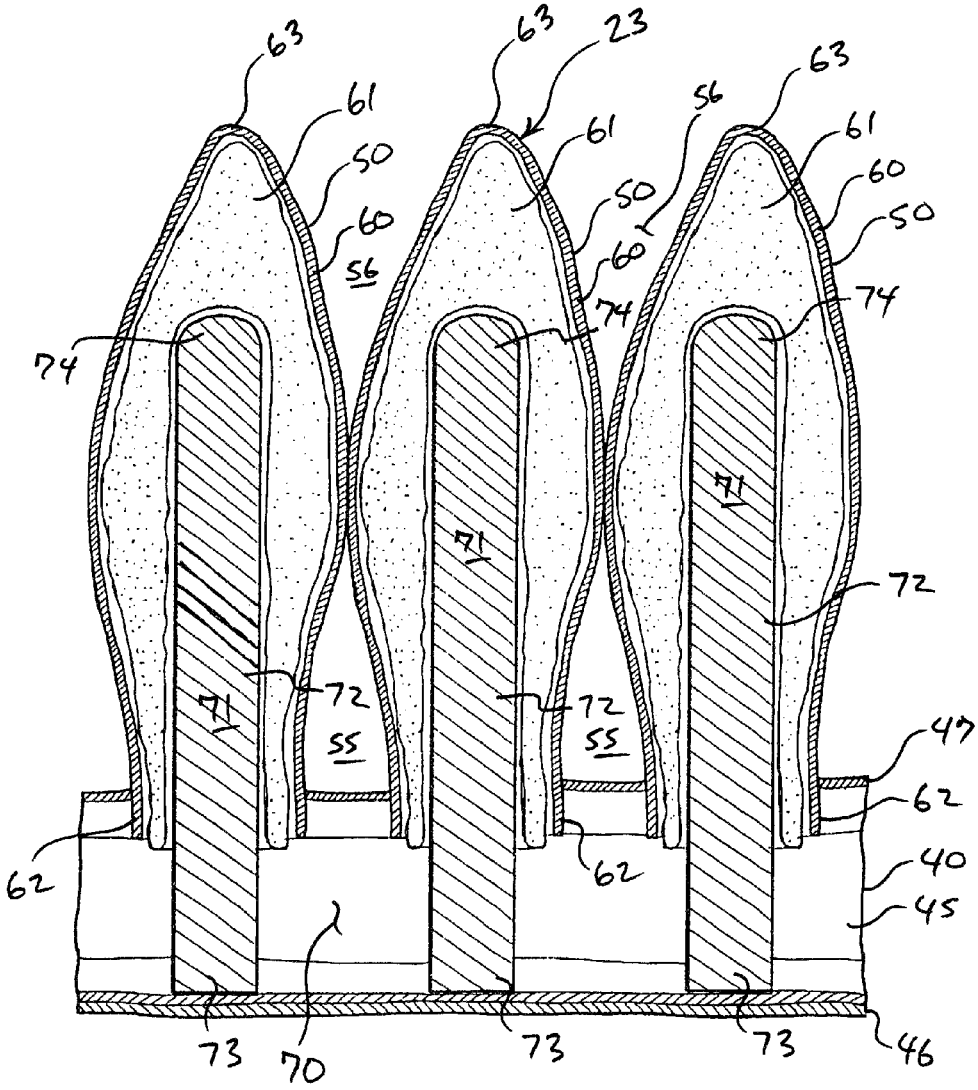
FIG. 5 is a sectional view of the crib bumper taken along line 5-5 of FIG. 2 illustrating a base supporting upstanding bumper elements incorporating supporting spines.

FIG. 3 is an enlarged fragmented perspective view of bed structure 20 with portions thereof and of selected ones of the bumper elements 50 of crib bumper 23 broken away for illustrative purposes showing supporting spines 71 incorporated therewith. FIG. 5 is a sectional view of crib bumper 23 taken along line 5-5 of FIG. 2 illustrating base 40 supporting upstanding bumper elements 50 incorporating supporting spines 71, and lower gaps 55 each formed between the lower ends 62 of opposed pairs of the bumper elements 50 of crib bumper 23 adjacent to upper continuous edge 47 of continuous sidewall 45 of base 40. Referencing FIGS. 3 and 5, each lower gap 55 is formed at and between each pair of opposed bumper elements 50 adjacent to upper continuous edge 47 of continuous sidewall 45 of base 40, and each upper gap 56 is formed between the upper ends 63 of each pair of opposed bumper elements 50, and each upper gap 56 opposes a lower gap 55 formed between each such pair of opposed bumper elements 50. As clearly shown in FIGS. 1 and 2, bumper elements 50 are attached to upper continuous edge 47 of continuous sidewall 45, and extend upright relative thereto to upper ends 63 with upper gap 56 formed between the upper ends 63 of each pair of opposed bumper elements 50.

To use crib bumper 34, mattress 21 is removed from bedstead 22 and base 40 is positioned atop mattress support 30 locating sheet 41 on mattress support 30, whereby continuous sidewall 45 projects upwardly from sheet 41 and mattress support 30 and is juxtaposed relative the inner sides of the enclosing sides of bedstead 22, otherwise lining the inner sides of endwalls 31 and 32 and sidewalls 33 and 34 of bedstead 22. Bumper elements 50 in turn extend upright from continuous upper edge 47 of continuous sidewall 45 and are juxtaposed relative the inner sides of the enclosing sides of bedstead 22, otherwise lining the inner sides of endwalls 31 and 32 and sidewalls 33 and 34 of bedstead 22, and together providing or otherwise forming a protective barrier between the inner sides of the enclosing sides of bedstead 22 and enclosed space 35 overlying base 40. Crib bumper 23 is sized and shaped to fit with bedstead 22 in the manner described.

After installing crib bumper 23 with bedstead 22, mattress 21 is applied into enclosed space 35 and is applied to mattress-receiving area 51A of base 40 through mattress-receiving opening 51 (FIG. 2) defined by bumper elements 50. When applied into mattress-receiving area 51A defined by base 40, lower surface 24 of mattress 21 rests against sheet 41, sleeping surface 25 faces upwardly toward enclosed space 35, and continuous sidewall 45 is positioned between perimeter 26 of mattress 21 and the inner sides of the enclosing sides of bedstead 22, namely, endwalls 31 and 32 and sidewalls 33 and 34, thereby encircling perimeter 26.

The relationship between mattress 21, bedstead 22, and crib bumper 23 is generally represented in FIG. 3 and in the cross sectional view of FIG. 4. The relationship of mattress 21 relative to bumper elements 50 is such that bumper elements 50 lining the inner sides of the enclosing sides of bedstead 22 extend upright therefrom sleeping surface 25 juxtaposed relative to the enclosing sides of bedstead 22 to upper ends 63 thereby cooperating together providing a continuous protective barrier between the enclosing sides of bedstead 22 and enclosed space 35 overlying sleeping surface 25 of mattress 22. Lower gaps 55 are located under upper gaps 56, and between each pair of opposed bumper elements there is one lower gap 55 and one opposed upper gap 56. Lower gaps 55 are formed between each pair of opposed bumper elements 50 adjacent to upper continuous edge 47 of continuous sidewall 45 of base 40 are located adjacent to sleeping surface 25 of mattress 21 at the point where bumper elements 50 and sleeping surface 25 of mattress 21 converge, which is substantially the point at which lower ends 61 of bumper elements 50 meet upper continuous edge 47 of continuous sidewall 45 of base 40. FIGS. 1 and 3 clearly illustrate lower gaps 55 at sleeping surface 25 and extending upwardly and away from sleeping surface 25. As clearly seen in FIGS. 1 and 3, a plurality of bumper elements 50 extend along each of the enclosing sides of bedstead 22, lower gaps 55 are each formed between a pair of opposed ones of the bumper elements 50 adjacent to sleeping surface 25 of mattress 21 and base 40, and a plurality of the lower gaps 55 are positioned at spaced intervals along each of the enclosing sides of bedstead 22 between the bumper elements 50 positioned at spaced intervals along each of the enclosing sides of bedstead 22. Upper gaps 56 formed between the upper ends 63 of each pair of opposed bumper elements 50 oppose lower gaps 55, as clearly shown in FIGS. 1 and 3. As clearly seen in FIGS. 1 and 3, a plurality of bumper elements 50 extend along each of the enclosing sides of bedstead 22, upper gaps 56 are each formed between the upper ends 63 of each pair of opposed ones of the bumper elements 50 opposing lower gaps 55, and a plurality of the upper gaps 56 are positioned at spaced intervals along each of the enclosing sides of bedstead 22 between the upper ends 63 of bumper elements 50 positioned at spaced intervals along each of the enclosing sides of bedstead 22. Bumper elements 50 are decorative and pleasing aesthetically, and the supporting spines 71 associated with bumper elements 50 maintain bumper elements 50 upright relative to mattress 21 in juxtaposition relative to the enclosing sides of bedstead 22 without the need to tie or otherwise attach bumper elements 50 directly to the enclosing sides of bedstead 22, in accordance with the principle of the invention. To remove crib bumper 23 such as for cleaning, the foregoing operation for installing crib bumper 23 need only be reversed.

Lower ends 73 of supporting spines 71 are located adjacent to lower edge 46 of continuous sidewall 45 and define a horizontal plane that is generally coincident with the horizontal plane defined by lower surface 24 of mattress 21, whereby they extend upwardly therefrom along perimeter 26 of mattress 21 into their corresponding bumper elements 50, in accordance with the principle of the invention. Accordingly, supporting spines 71 are sandwiched between perimeter 26 of mattress 21 and the upstanding enclosing sides of bedstead 22, which helps orient supporting spines 71 upright and, thus, in turn helps orient bumper elements 50 upright as herein explained.

Figure 6:
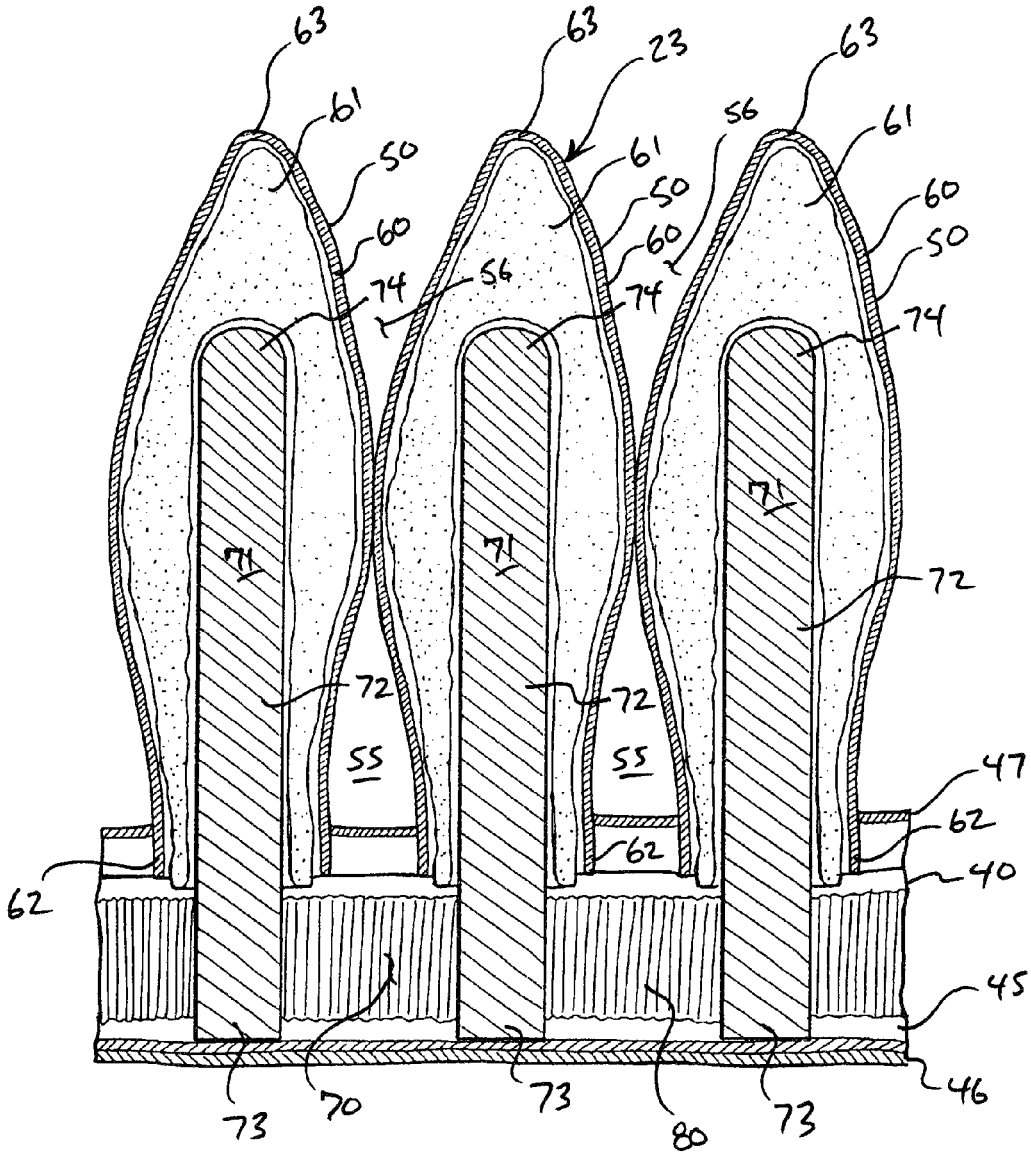
FIG. 6 is a view very similar to the view of FIG. 5 illustrating an elastic band incorporated with the base of the crib bumper.

FIG. 6 is a view of crib bumper 23 very similar to the view of FIG. 5 illustrating an elastic band 80 incorporated with base 40, and, more particularly, with continuous sidewall 45 of base 40. Elastic band 80 is situated in pocket 70 in this embodiment, and functions to elastically constrict continuous sidewall 45 of base 40 to perimeter 26 of mattress 21 received by base 40 as previously described. Elastic band 80 is an optional and desirable feature as it ensures an aggressive and efficient securing of base 40 to mattress 21. Elastic band 80 can be omitted, if desired. Elastic band 80 is continuous in a preferred embodiment, running through pocket 70 along the entire length of continuous sidewall 45. If desired, elastic band 80 can be externally mounted to continuous sidewall 45, or incorporated with continuous sidewall 45 in other ways. Although in the preferred embodiment elastic band 80 is continuous, it may be fashioned as a plurality of separate attached bands, whether attached together or attached at spaced intervals along continuous sidewall 45. Any suitable material may be used to construct elastic band 80.

Figure 7:
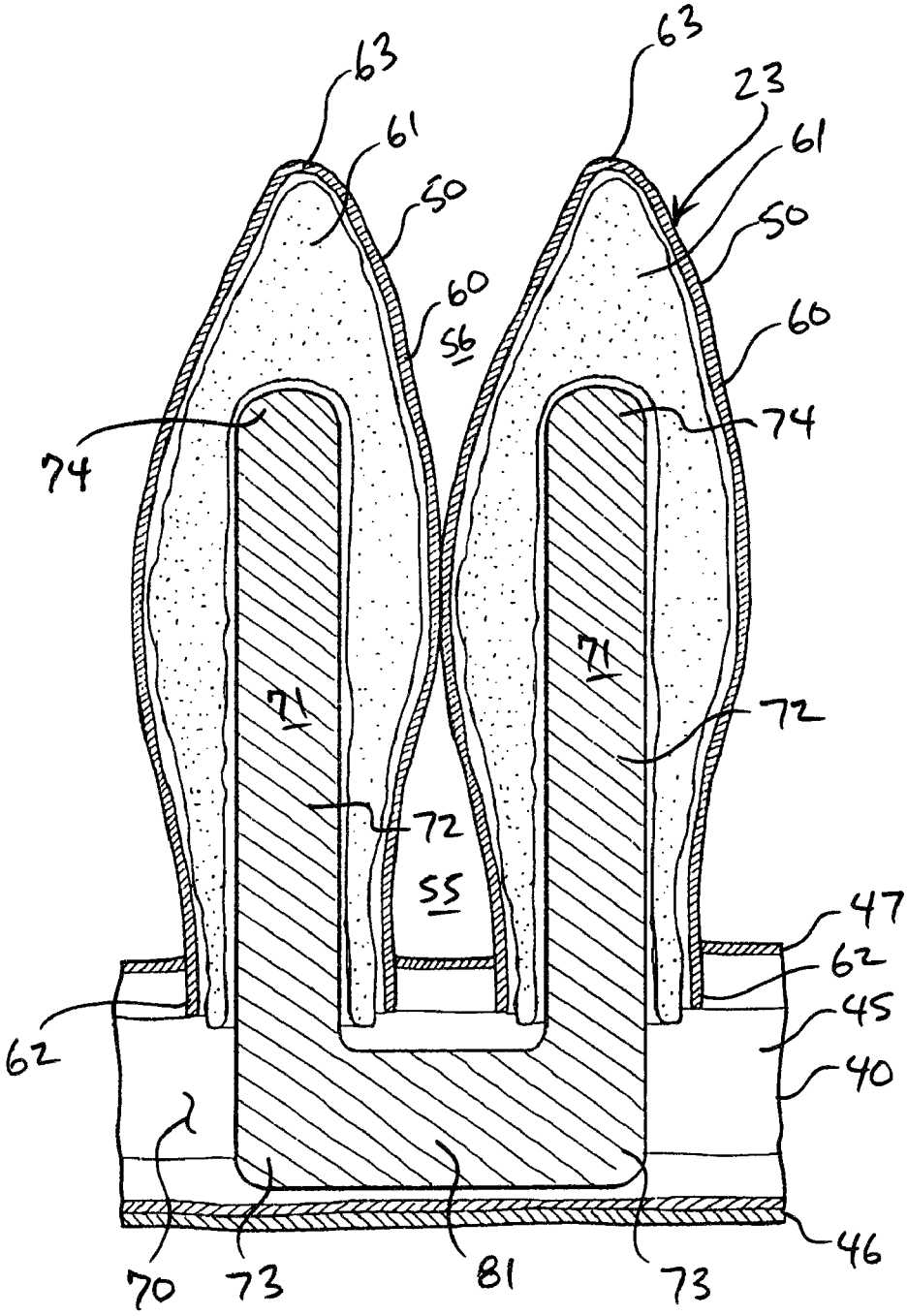
FIG. 7 is a vertical sectional view very similar to that of FIG. 5 illustrating an alternate embodiment of supporting spines incorporated with the upstanding bumper elements.

FIG. 7 is a vertical sectional view very similar to that of FIG. 5 illustrating an alternate embodiment of supporting spines 71 incorporated with upstanding bumper elements 50. In this embodiment, the lower ends 73 of a pair of adjacent supporting spines 71 of a corresponding pair of bumper elements 50 are interconnected with a bridge 81 located in pocket 70 extending between lower ends 73, which imparts enhanced rigidity to continuous sidewall 45 and a corresponding increased rigidity into the corresponding bumper elements 51. Although the lower ends of only two adjacent supporting spines 71 are illustrated in FIG. 7, more can be so interconnected, if desired, such as three or four or more, for introducing still more increased rigidity into continuous sidewall 45 and into the corresponding bumper elements 50.

Figure 8:
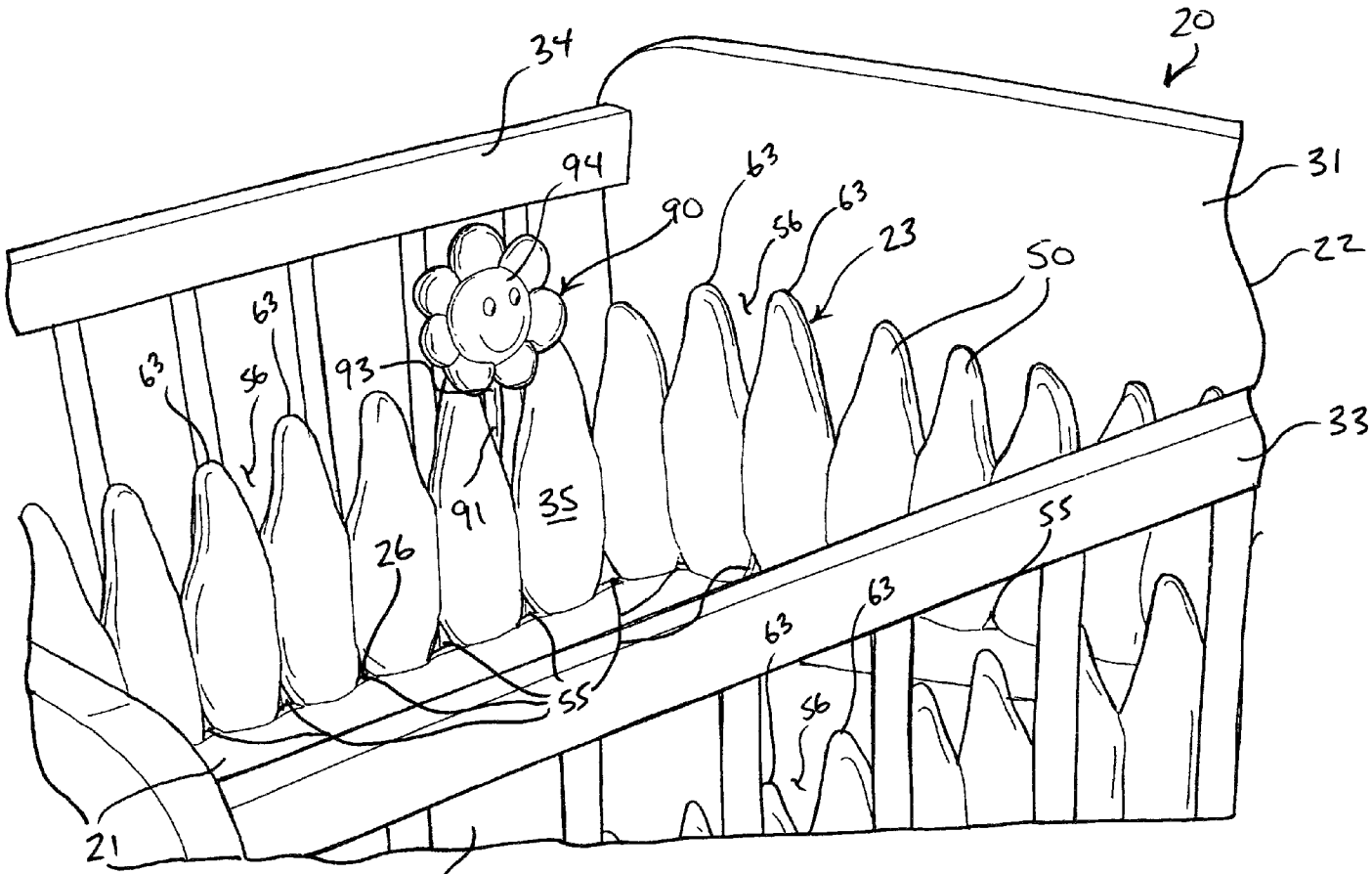
FIG. 8 is an enlarged fragmented perspective view of the bed structure of FIG. 1 showing the crib bumper as it would appear incorporating a decorative attachment.
Figure 9:
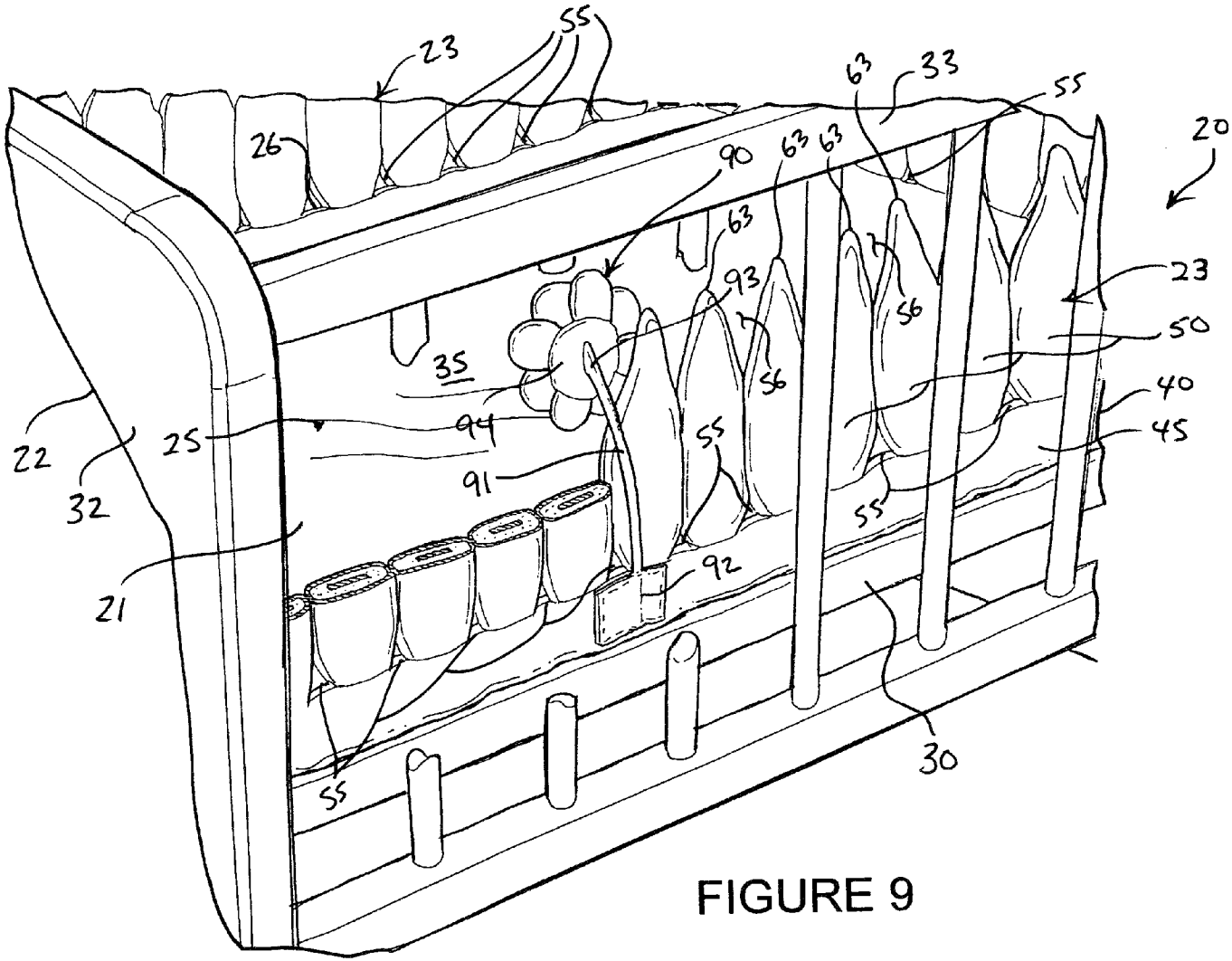
FIG. 9 is an enlarged fragmented perspective view of the bed structure of FIG. 8 with portions thereof and of the crib bumper broken away for illustrative purposes illustrating the attachment of the decorative attachment.
Figure 10:
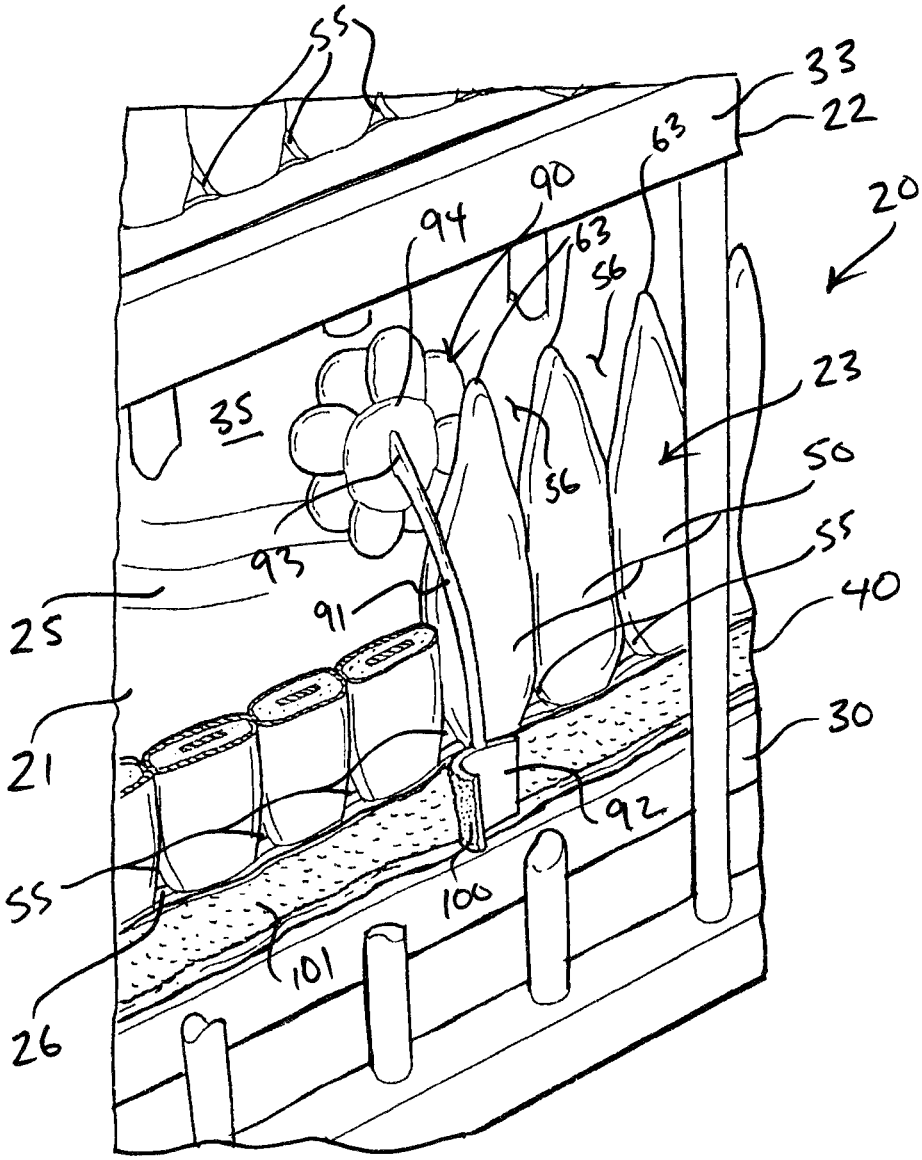
FIGS. 10-13 illustrate alternate embodiments of attaching the decorative element of FIG. 9.

Reference is now made to FIG. 8, which is an enlarged fragmented perspective view of bed structure 20 showing crib bumper 23 as it would appear incorporating a decorative attachment 90. Looking to FIG. 9, decorative attachment 90 consists of an elongate body 91 having a lower end 92 affixed to base 40 and an opposing upper end 93 that supports a decorative ornament 94. In this embodiment, lower end 92 is applied to continuous sidewall 45, and is stitched to the outer face of continuous sidewall 45. In FIGS. 9 and 10, crib bumper 23 is installed in conjunction with bed structure 20 as previously described, whereby decorative attachment 90 extends upright relative to mattress 21 juxtaposed relative to the protective barrier formed by bumper elements 50. Elongate body 91, which can be encased in or coated with fabric or other selected material, is formed of plastic or other material capable of maintaining shape, which allows decorative attachment 90 to situate itself upright as herein disclosed. The decorative upper end of decorative attachment 90 is characterized by decorative ornament 94 attached to upper end 93, which extends upwardly relative to, and in juxtaposition with, the protective barrier formed by bumper elements 50 thereby providing a point of interest for a baby set onto sleeping surface of mattress 21, as generally illustrated in FIG. 8.

Although crib bumper 23 in FIGS. 8 and 9 is shown as it would appear incorporating one decorative attachment, more can be provided, if desired. Also, in the present embodiment decorative ornament 94 is provided in the shape of a flower having a central portion formed with a fun, smiley face, as shown in FIG. 8. Those having regard for the art will readily appreciate that decorative ornament 84 can be formed to take on any desired shape or form as may be desired.

Decorative attachment 90 can be attached to crib bumper 23 in many ways, and FIGS. 10-13 illustrate alternate embodiments of engagement assemblies for attaching decorative element 90 of FIG. 9 as a matter of example. In FIG. 10, a hook-and-loop fastener is provided securing lower end 92 of decorative attachment 90 to base 40, including an element 100 thereof applied to lower end 92 of decorative attachment 90 and a complemental element 101 thereof applied to continuous sidewall 45 of base 40. In the immediate embodiment, the element 100 applied to lower end 92 of decorative attachment 90 consists of the loop element of the hook-and-loop fastener, and the complemental element 101 applied to continuous sidewall 45 of base 40 consists of the corresponding hook element of the hook-and-loop fastener, although this can be reversed, if desired. Complemental element 101 is applied to the outer face of continuous sidewall 45, and extends along the entire length of continuous sidewall 45 thereby allowing decorative attachment 90 to be attached to base 40 at any desired location therealong continuous sidewall 45.

Figure 11:
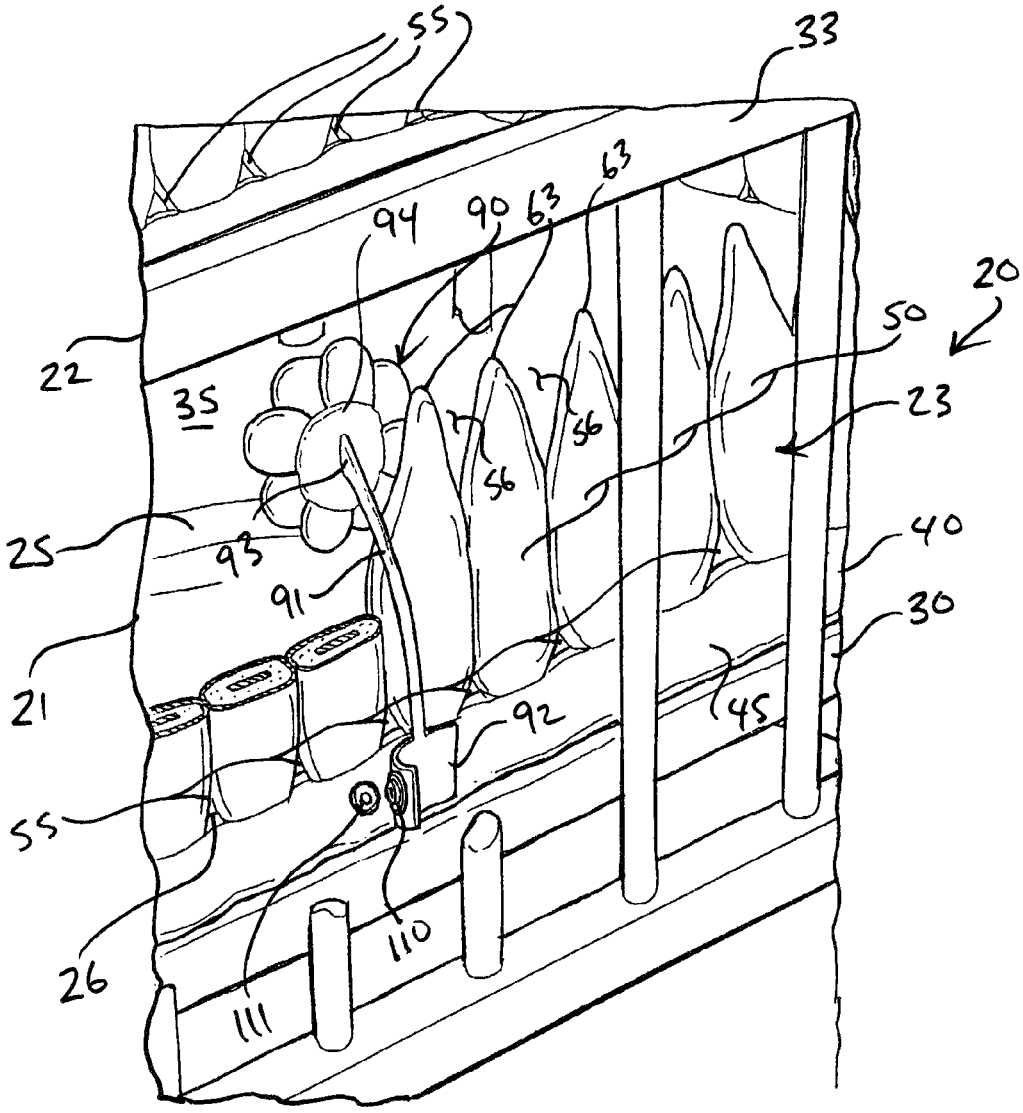

In FIG. 11, a snap fastener is provided securing lower end 92 of decorative attachment 90 to base 40, including an element 110 thereof applied to lower end 92 of decorative attachment 90 and a complemental element 111 thereof applied to continuous sidewall 45 of base 40. In the immediate embodiment, the element 110 applied to lower end 92 of decorative attachment 90 consists of the male snap element of the snap fastener, and the complemental element 111 applied to continuous sidewall 45 of base 40 consists of the corresponding female snap element of the snap fastener, although this can be reversed, if desired. Complemental element 111 is applied to the outer face of continuous sidewall 45, and may be applied at any location along continuous sidewall 45. Typically two or more snap fasteners are used to snap fasten decorative attachment 90 to base 40, although only one snap fastener is illustrated in FIG. 11.

Figure 12:
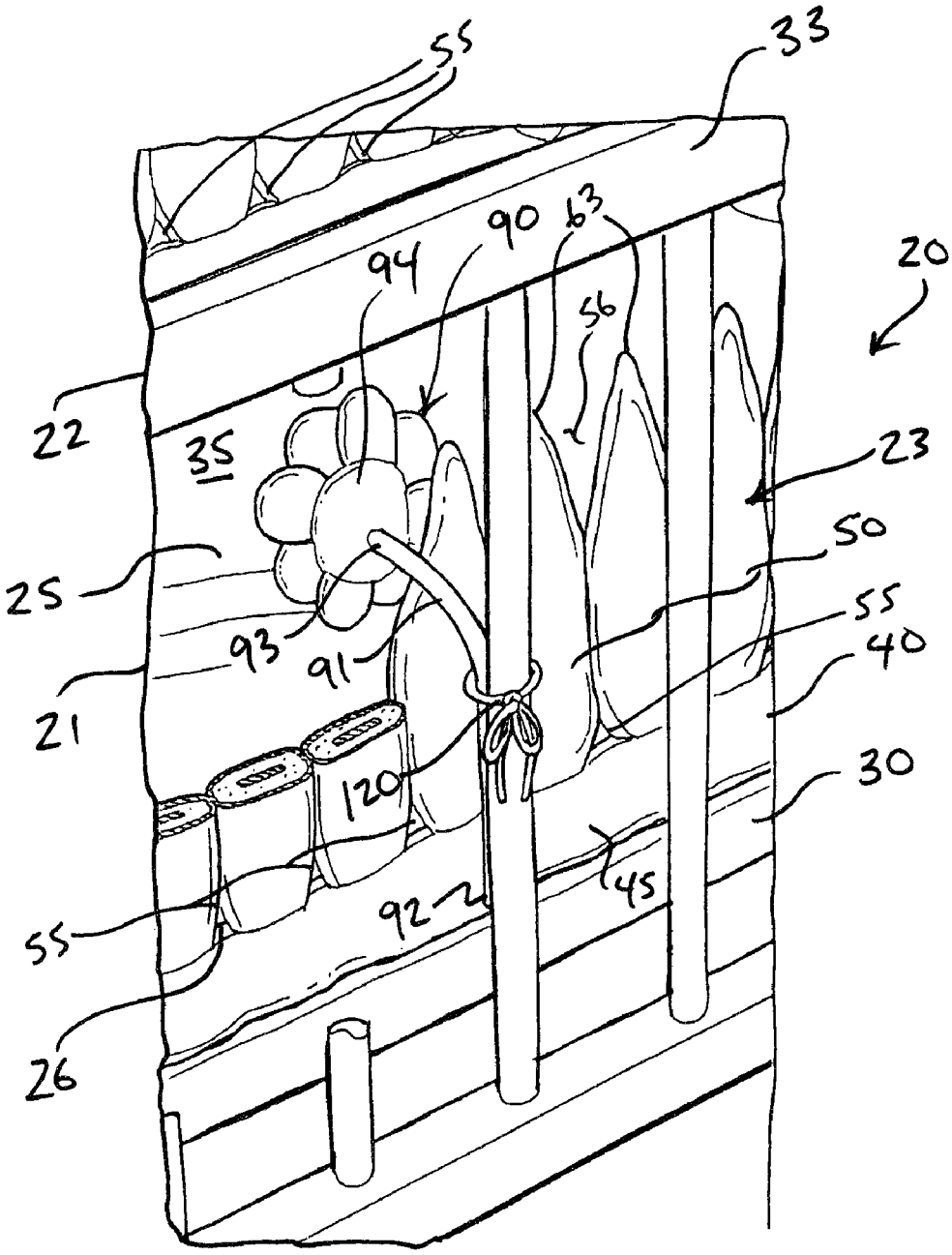
Figure 13:
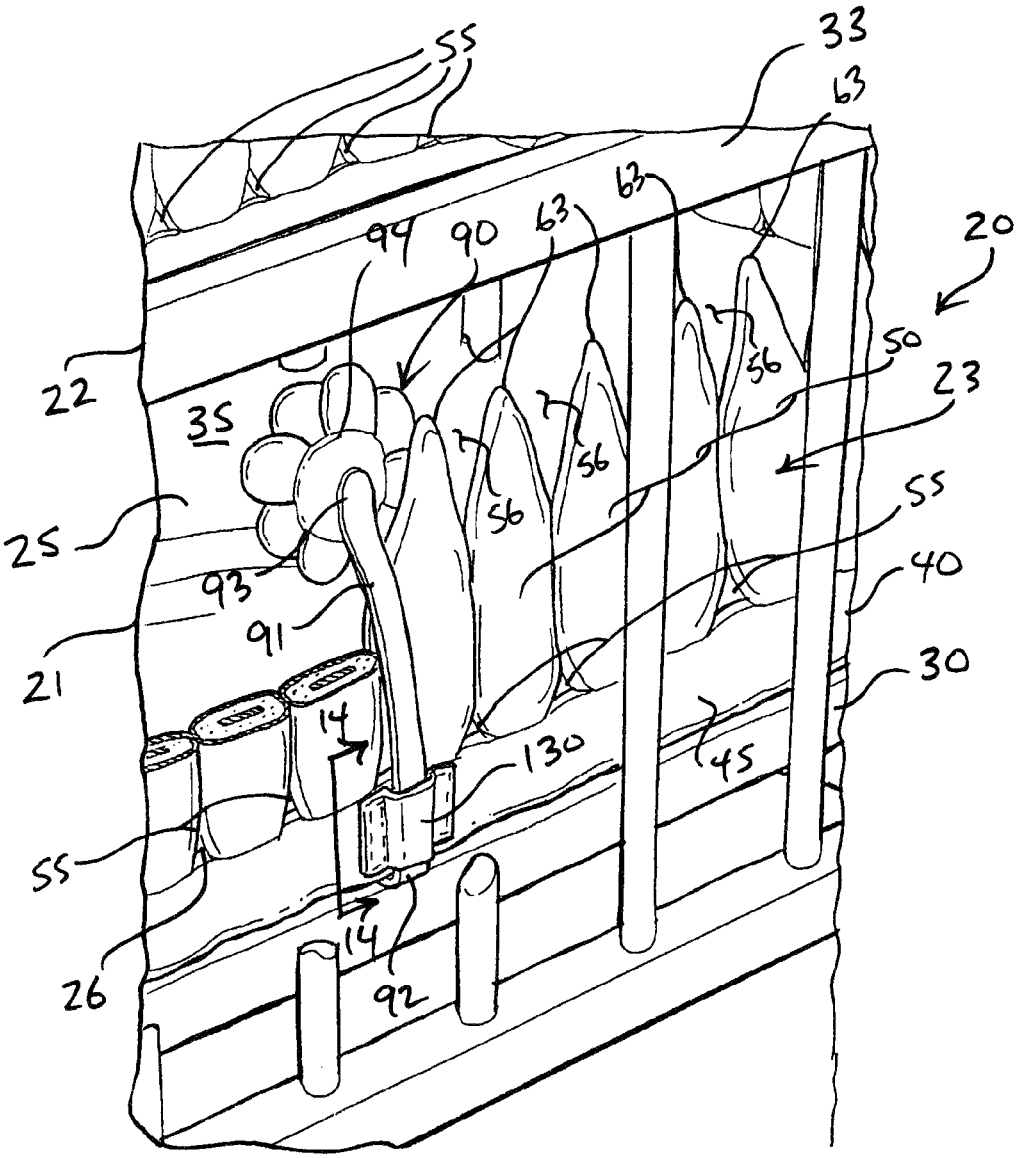
Figure 14:
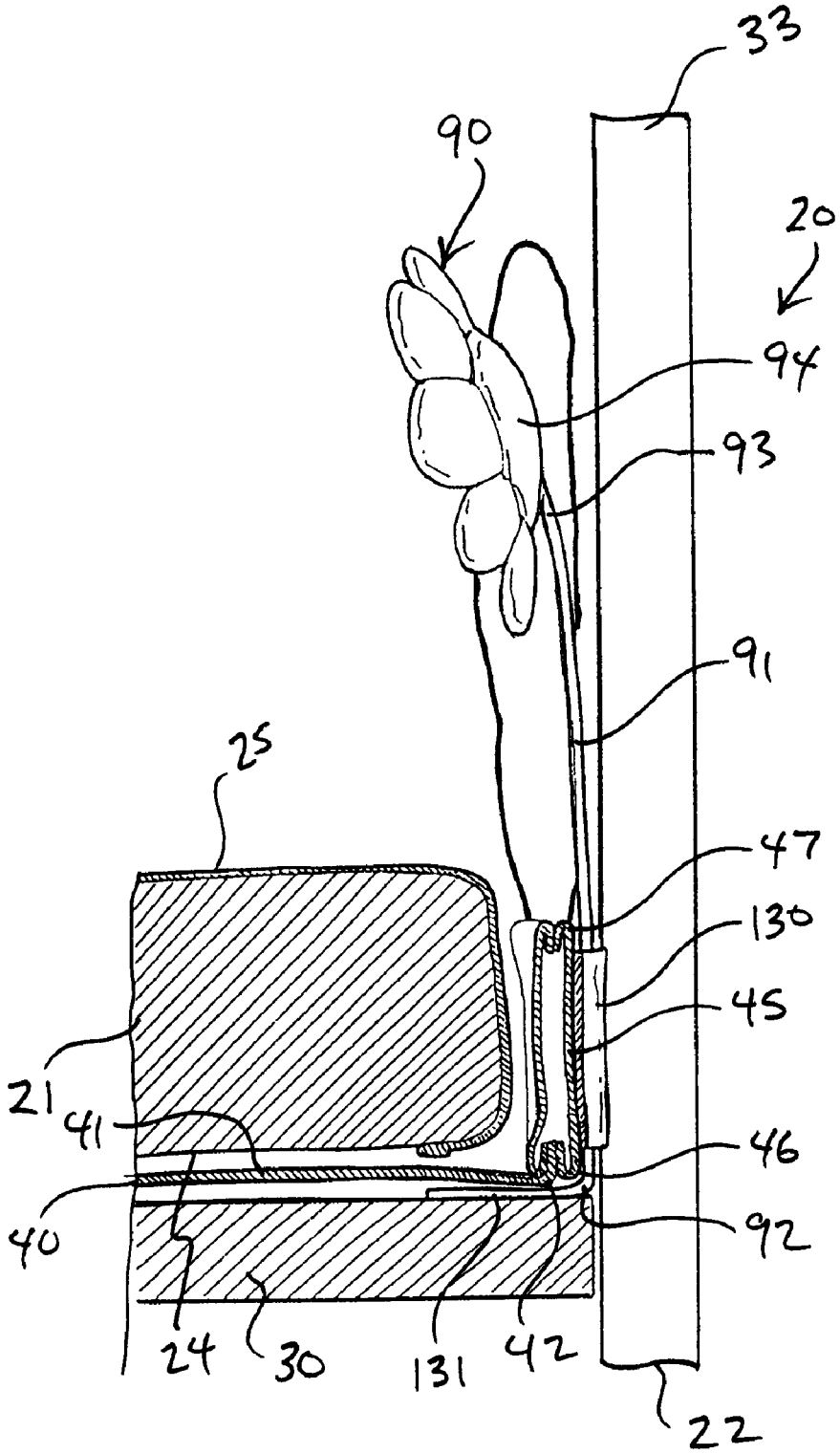
FIG. 14 is a sectional view taken along line 14-14 of FIG. 13.

In FIG. 12, a tie 120 applied between lower and upper ends 92 and 93 of elongate body 91 is used to fasten decorative attachment 90 to a slat of sidewall 33 of bedstead 22, orienting decorative attachment 90 in its orientation as previously described. In FIG. 13, a pocket 130 is applied, such as by stitching or glue or the like, to the outer face of continuous sidewall 45 through which extends lower end 92 of elongate body 91 of decorative attachment 90. Looking to FIG. 14, which is a sectional view taken along line 14-14 of FIG. 13, lower end 92 of elongate body 91 in this specific embodiment is fashioned with a foot 131, which extends inwardly toward perimeter 26 of mattress 21 underlying sheet 41 of base 40 and mattress 21, in which the weight of mattress 21 applied to foot 131 in combination with the retention of elongate body 91 to the outer face of continuous sidewall 45 with pocket 130 cooperate anchoring decorative attachment 90 in place, according to the principle of the invention.

Those having regard for the art will readily appreciate that a new and useful crib bumper 23, and bedstead 22 with mattress 21 incorporating crib bumper 23, is disclosed. Crib bumper 23 is easy to manufacture, and easy to install require no fastening structure between crib bumper 23 and bedstead 22 to properly and competently secure crib bumper 23 in place in conjunction with mattress 21 and bedstead 22. Crib bumper 23 is safe, and is useful having industrial applicability in that it is used to line the inside of bedstead 22 for preventing a baby situated on sleeping surface 25 of mattress 21 from hurting himself on bedstead 22, and helps keep arms and legs inside bedstead 22 where they belong. Decorative attachment 90 provides a point of interest for a baby situated on sleeping surface 25 of mattress 21, and is easily to install in conjunction with crib bumper 23, whereby the present disclosure teaches many different convenient ways of attaching decorative attachment 90 to crib bumper 23.

The invention has been described above with reference to the best modes for carrying out the invention. However, those skilled in the art will recognize that changes and modifications may be made to the embodiment without departing from the nature and scope of the invention. For instance, crib bumper 23 may be shaped in any desired shape for fitting in conjunction with mattresses and bedsteads 22 having varying shapes, such as round, square, oval, etc. Also, decorative attachments constructed and arranged in accordance with the principle of the invention can be attached to one or more of bumper elements 50 of crib bumper 23 in lieu of, or in addition to, the attachment to base 40. Further, engagement structure can be incorporated between bumper elements 50 and the enclosing sides of bedstead 22 for securing bumper elements 50 to bedstead in the installation of crib bumper 23 in conjunction with bedstead 22, wherein the engagement structure may include any suitable engagement structure such as hook-and-loop fasteners, snap fasteners, clips, ties, suction cups, buttons, or the like.

Various further changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A bed structure, comprising:

a mattress, having a perimeter and a sleeping surface, carried by a bedstead including enclosing sides encircling the perimeter of the mattress and extending upwardly with respect to the sleeping surface defining an enclosed space overlying the sleeping surface;

a base positioned between the bedstead and the mattress, the base having a continuous sidewall encircling the perimeter of the mattress;

bumper elements, each bumper element having an upper end and a lower end, the lower end being coupled to the sidewall of the base, the bumper elements being arranged along the sidewall such that a portion of each bumper element abuts a portion of an adjacent bumper element, each bumper element extending upright from the sleeping surface of the mattress and adjacent to the enclosing sides of the bedstead, the bumper elements configured to provide a protective barrier between the enclosing sides of the bedstead and the enclosed space overlying the sleeping surface of the mattress; and upper and lower gaps formed between adjacent bumper elements, the upper gap being formed between the upper ends of adjacent bumper elements, and the lower gap being formed between the lower ends of adjacent bumper elements.

2. The bed structure according to claim 1, wherein each of the bumper elements includes a first face and a second face, and a supporting spine positioned between the first face and the second face, the spine maintaining the bumper elements upright relative to the mattress juxtaposed relative to the enclosing sides of the bedstead.

3. The bed structure according to claim 2, wherein the supporting spines are coupled to the continuous sidewall.

4. The bed structure according to claim 1, further comprising a decorative attachment having a lower end coupled to the continuous sidewall and an opposing decorative upper end, the decorative upper end extending upwardly relative to the mattress juxtaposed relative to the protective barrier formed by the bumper elements.

5. The bed structure according to claim 3, wherein the decorative upper end further extends upwardly relative to the protective barrier formed by the bumper elements.

6. The bed structure according to claim 5, further comprising an engagement assembly coupling the lower end of the decorative attachment to the continuous sidewall including an element thereof carried by the continuous sidewall engaged to a complemental element thereof carried by the lower end of the decorative attachment.

7. The bed structure according to claim 6, wherein the element of the engagement assembly includes one of a hook fastening element and a loop fastening element, and the complemental element of the engagement assembly includes the other of the hook fastening element and the loop fastening element.

8. The bed structure according to claim 6, wherein the element of the engagement assembly includes one of a male snap element and a female snap element, and the complemental element of the engagement assembly includes the other of the male snap element and the female snap element.

9. The bed structure according to claim 1, further comprising means elastically constricting the continuous sidewall relative to the perimeter of the mattress, elastically retaining the base to the mattress.

10. A crib bumper, comprising:

a mattress-receiving base;

a continuous sidewall of bumper elements, the bumper elements each having an upper end and a lower end, the lower end attached to the base, and the bumper elements being arranged such that a portion of each bumper element abuts a portion of an adjacent bumper element, the bumper elements extending upright from the base and defining a mattress-receiving opening into the base; and upper and lower gaps formed between adjacent bumper elements, the upper gap being formed between the upper ends of adjacent bumper elements, and the lower gap being formed between the lower ends of adjacent bumper elements.

11. The crib bumper according to claim 10, wherein each of the bumper elements includes a first face and a second face, and a supporting spine positioned between the first face and the second face, the spine maintaining the bumper elements upright relative to the base.

12. The crib bumper according to claim 11, further comprising:

the base comprises a broad sheet defining an outer perimeter edge, and a continuous sidewall having a continuous lower edge attached to the outer perimeter edge and projecting upwardly therefrom terminating with a continuous upper edge;

a mattress-receiving area bound by and between the broad sheet and the continuous sidewall;

the bumper elements attached to, and projecting upwardly from, the continuous upper edge of the continuous sidewall; and the supporting spines coupled to the continuous sidewall.

13. The crib bumper according to claim 10, further comprising means carried by the base for elastically constricting the base to a mattress received thereby.

* * * * *